United States Patent [19]

Maitlen et al.

[11] Patent Number: 5,025,994

[45] Date of Patent: Jun. 25, 1991

[54] MEDICAL WASTE GRINDER

[75] Inventors: C. Gene Maitlen, Cushing; Simon G. Franks, Edmond, both of Okla.

[73] Assignee: Pelibe, an OK Partnership, Cushing, Okla.

[21] Appl. No.: 436,602

[22] Filed: Nov. 15, 1989

[51] Int. Cl.[5] ..... B02C 18/16; B02C 19/14

[52] U.S. Cl. ..... 241/99; 241/100; 241/159; 241/236; 241/293; 241/DIG. 38

[58] Field of Search ..... 241/100, 99, 236, 101.2, 241/159, 293, 294, DIG. 38, 295

[56] References Cited

U.S. PATENT DOCUMENTS

| | | | |
|---|---|---|---|
| 1,512,929 | 10/1924 | Himoff | 241/236 X |
| 3,502,276 | 3/1970 | Panning et al. | 241/236 X |
| 3,664,592 | 5/1972 | Schweigert et al. | 241/236 X |
| 4,165,043 | 8/1979 | Higashi et al. | 241/236 |

FOREIGN PATENT DOCUMENTS

| | | | |
|---|---|---|---|
| 316067 | 11/1919 | Fed. Rep. of Germany | 241/236 |
| 863862 | 1/1953 | Fed. Rep. of Germany | 241/236 |
| 963267 | 5/1957 | Fed. Rep. of Germany | 241/236 |
| 1161238 | 1/1964 | Fed. Rep. of Germany | 241/236 |
| 2600161 | 7/1976 | Fed. Rep. of Germany | 241/236 |
| 3234485 | 3/1984 | Fed. Rep. of Germany | 241/236 |
| 2542632 | 9/1984 | France | 241/236 |
| 9933 | 11/1923 | Netherlands | 241/236 |

*Primary Examiner*—Mark Rosenbaum

*Attorney, Agent, or Firm*—Dunlap, Codding Peterson & Lee

[57] ABSTRACT

An apparatus for grinding hypodermic syringes or needles, IV needles and other medical waste into relatively fine particles. The apparatus includes a housing having a case therein defining an inlet and an outlet. A plurality of rotors are disposed in the case, and each of the rotors has a plurality of radially outwardly extending teeth therein which interact with teeth on the other rotors to grind the syringes or needles. A discharge valve is provided for controlling the flow of particles discharged from the case. The teeth on the rotors are longitudinally and circumferentially spaced. Generally, the teeth on at least one of the rotors extend between the teeth on another of the rotors. Also, the teeth on at least a pair of the rotors have angled sides which are angled in opposite directions such that the angled sides of the teeth on one rotor generally face, and are aligned with, the corresponding angled sides of the teeth on the other rotor. Each of the teeth also has a first edge and an angled edge extending at an angle with respect to the first edge.

26 Claims, 4 Drawing Sheets

MEDICAL WASTE GRINDER

BACKGROUND OF THE INVENTION

1. Field Of The Invention

This invention relates to apparatus for grinding hypodermic syringes or needles, intravenous (IV) needles, and other hazardous medical waste. More particularly, the invention relates to a medical waste grinder having rotors with teeth thereon which interact to grind the syringes into relatively small particles.

2. Description Of The Prior Art

A prior art device for destructing syringes is disclosed in U.S. Pat. No. 3,750,966 to Anderson. This device has a pair of counterrotating rolls with teeth extending therefrom. The sharp edge of a tooth on one roll just contacts the sharp edge of a tooth on the opposite roll, at the nip formed between the rolls. The teeth extend longitudinally along the length of each of the rolls. This device breaks syringes into a plurality of discrete pieces, but such pieces might still be large enough to be hazardous. The present invention solves this problem by grinding the syringe into relatively small particles.

U.S. Pat. No. 1,534,855 to Lowenthal discloses a crusher having a pair of crushing rolls with teeth thereon which are engaged with one another in a gear-like fashion. While this apparatus, if adapted for use with syringes, would probably grind the syringes into pieces about as small as the apparatus of Anderson, it is possible, as noted in Anderson, that the plastic material of the syringes could quickly clog the valleys or depressions in the rolls used in Lowenthal. The apparatus of the present invention solves this problem by having a plurality of discrete teeth which are longitudinally spaced and by the interaction between teeth on different rollers, is effectively self-cleaning.

U.S. Pat. No. 3,926,279 to Dryden et al. discloses a hammermill type arrangement and includes means for pumping a disinfectant into the hammermill section to disinfect the disintegrated syringes. Relatively large particles of the syringe may still exit the apparatus.

The apparatus of the present invention provides a medical waste grinder which solves problems associated with prior art devices by grinding the waste, such as a syringe, into relatively fine, powderlike particles with a configuration which is self-cleaning to prevent clogging thereof by the particles.

SUMMARY OF THE INVENTION

The medical waste grinder of the present invention is adapted for grinding hypodermic syringes or needles, IV needles or other medical waste into relatively small particles, and preferably a relatively fine powder. In general, the apparatus comprises case means for forming an enclosure with an inlet and an outlet and a plurality of rotors rotatably disposed in the enclosure, each of the rotors having a plurality of longitudinally spaced rows of teeth thereon. The teeth on the rotors interact to grind up waste fed into the inlet and to discharge the resulting fine particles through the outlet of the case means. In the preferred embodiment, the apparatus further comprises a housing with the case means positioned therein. A means may be provided for collecting the ground particles as they are discharged from the case means. A further means may be provided for injecting a disinfectant into the inlet.

Each of the rotors of the grinder generally comprises a substantially cylindrical portion and a plurality of longitudinally and circumferentially spaced teeth extending outwardly from the cylindrical portion. Each of the teeth has a first edge and a second edge extending angularly with respect to the first edge. In a first type of rotor, each tooth has a first side extending substantially radially from the cylindrical portion and an angled second side extending angularly with respect to the first side. The angled sides may be angled in different directions, but preferably the angled sides on a single rotor extend in the same direction with respect to the cylindrical portion. In a second type of rotor, each of the teeth has a pair of substantially parallel sides. In one embodiment, the teeth of either type of rotor have a radially outer edge or tip which is substantially flat.

In one preferred embodiment, a first of the rotors adjacent to the inlet and the rotor adjacent to the outlet are of the first type having angled second sides on the teeth. The rows of teeth are aligned, and the second sides of teeth on one rotor are angled in an opposite direction from the other rotor so that the angled second sides thereof are substantially parallel and generally face one another. In this embodiment, the second of the rotors adjacent to the inlet is of the second type, and the teeth thereon are staggered with respect to the teeth on the other rotors so that the teeth on the first rotor adjacent to the inlet and the rotor adjacent to the outlet extend between the teeth on the second of the rotors adjacent to the inlet.

In this just described embodiment, the apparatus further comprises means for rotating the pair of rotors adjacent to the inlet in opposite directions, and further includes a means for rotating the second of the rotors adjacent to the inlet slower than the first of the rotors adjacent to the inlet. A means is also provided for rotating the rotor adjacent to the outlet in an opposite direction from the second of the inlet rotors. Preferably, the rotor adjacent to the outlet and the first rotor adjacent to the inlet rotate in the same direction at substantially the same speed.

A discharge valve may be disposed adjacent to the outlet of the case means to control the flow of ground medical waste particles through the outlet.

It is an important object of the present invention to provide a grinding apparatus for grinding hypodermic syringes or needles, IV needles or other medical waste into relatively small particles.

It is a further object of the invention to provide a medical waste grinder which is self-cleaning.

It is a further object of the invention to provide a medical waste grinder having a plurality of rotors in an enclosure wherein the rotors have longitudinally spaced teeth thereon such that the teeth on at least one of the rotors extends between teeth on another of the rotors.

Still another object of the invention is to provide a medical waste grinder having a rotor with a plurality of teeth with angled sides thereon which generally face, and are aligned with, corresponding angled sides of teeth on another rotor.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
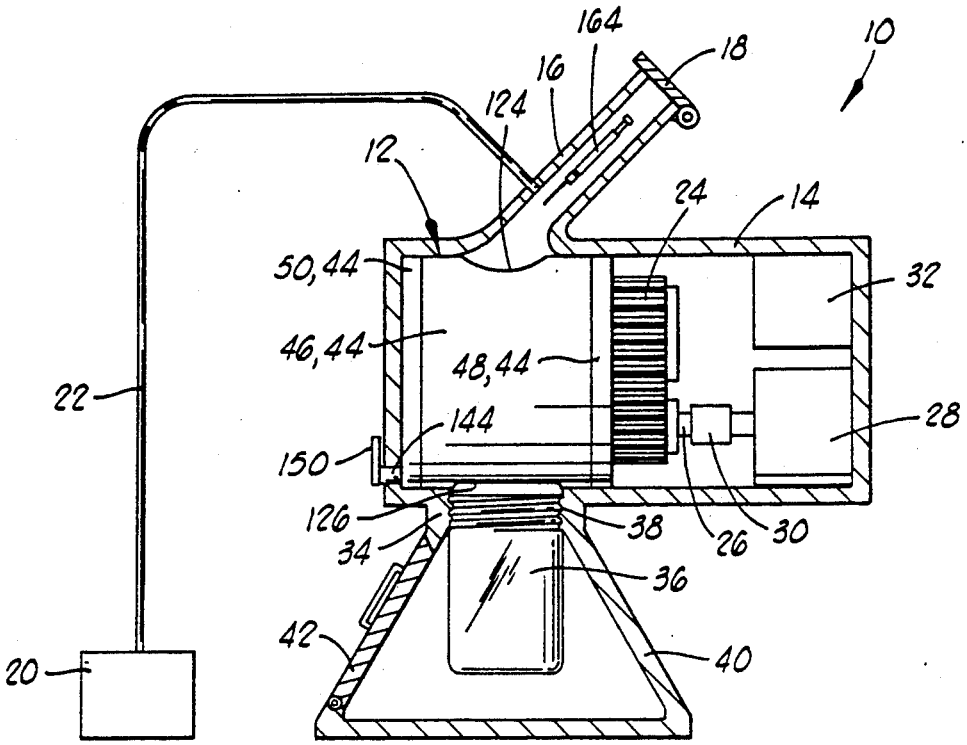
FIG. 1 illustrates a vertical partial cross section of the medical waste grinder of the present invention.

Referring now to the drawings, and more particularly to FIG. 1, the medical waste grinder of the present invention is shown and generally designated by the numeral 10. The primary portion of grinder 10 is grinder section 12 which is disposed within an outer housing 14.

Housing 14 has an inlet portion or nozzle 16 which in the illustrated embodiments extends at an acute angle with respect to a longitudinal axis of the housing and has a spring biased hinged door 18 at the end thereof. A pump 20 is connected to inlet 16 by a line 22. Pump 20 is adapted for pumping disinfectant from a reservoir (not shown) into inlet nozzle 16.

Grinder section 12 has at one end a gear train 24 with a drive shaft 26 extending therefrom, as will be further described herein. A motor 28 is positioned in housing 14. Motor 28 is connected to drive shaft 26 by a coupling 30 or other means. Housing 14 may also contain controls 32 for motor 28 as necessary.

Below grinder section 12, housing 14 has an outlet portion 34. A collection jar or container 36 is attached to outlet portion 34 such as by a threaded connection 38. Jar 36 extends downwardly into a support section 40 of housing 14. Support section 40 has a hinged door 42 thereon through which jar 36 may be installed or removed.

Referring now to FIGS. 2–6, a preferred embodiment of grinder section 12 will be discussed. Grinder section 12 includes a case means 44 for forming an enclosure. Case means 44 has a longitudinal axis which is substantially the same as or parallel to the longitudinal axis of housing 14. In the embodiment shown, case means 44 is characterized by a case assembly comprising a body 46 with first and second end plates 48 and 50 attached thereto by fastening means, such as bolts 52. End plates 48 and 50 are preferably substantially identical.

Figure 5:
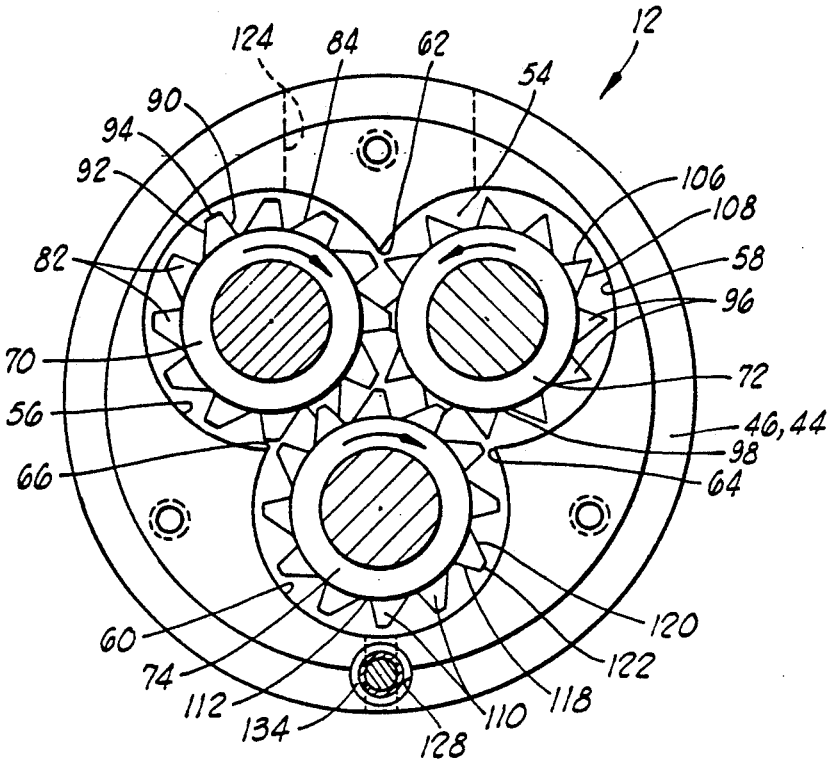
FIG. 5 is a cross section taken along lines 5—5 in FIG. 3.

As best seen in FIG. 5, body 46 defines a central cavity 54 therein. Cavity 54 has a lobed configuration, and in the embodiment shown in the drawings, comprises first, second and third lobes 56, 58 and 60, respectively, although more or fewer lobes could be used in the invention. Lobes 56, 58 and 60 are preferably interconnecting cylindrical bores forming vertices 62, 64 and 66.

Figure 7:
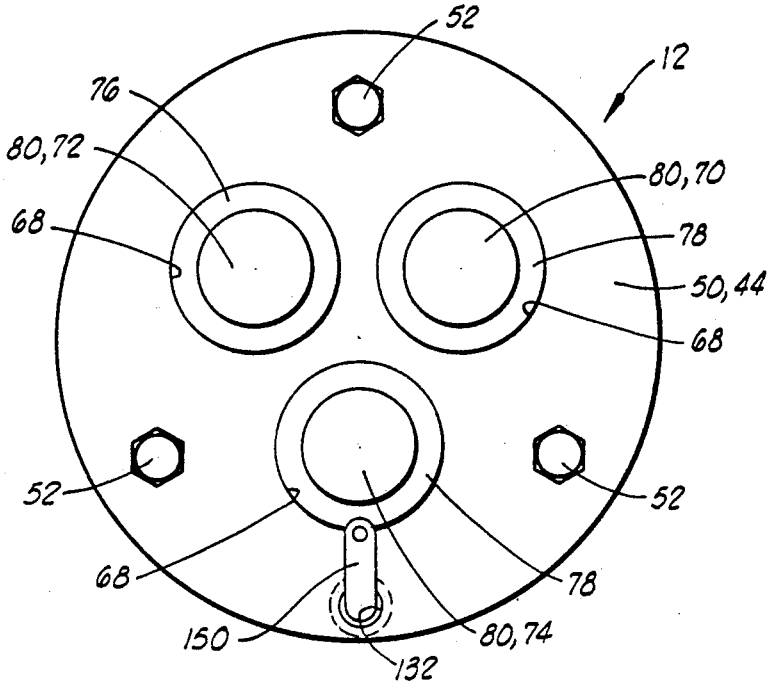
FIG. 7 shows an end view of the grinder section opposite the view shown in FIG. 2.

Referring also to FIG. 7, second end plate 50 defines a plurality of openings 68 therethrough. First end plate 48 also defines a corresponding set of openings 68 therethrough. Openings 68 in first end plate 48 are aligned with openings 68 in second end plate 50. Each of openings 68 is aligned and coaxial with a corresponding lobe 56, 58 or 60 of cavity 54 in body 46.

Referring again to FIGS. 3–6, a first rotor 70 is disposed in first lobe 56 of cavity 54 in body 46. Similarly, a second rotor 72 is disposed in second lobe 58, and a third rotor 74 is disposed in third lobe 60. As seen in FIGS. 3, 4, 6 and 7, each of rotors 70, 72 and 74 has a first shoulder portion 76 which extends into the corresponding openings 68 in first end plate 48. Each first shoulder portion 76 is supported in the corresponding opening 68 by a bearing 78. Bearings 78 are of a kind known in the art, such as sealed needle or roller bearings. On the opposite end of each of rotors 70, 72 and 74 is a second shoulder portion 80 which extends into the corresponding opening 68 in second end plate 50. Each second shoulder portion 80 is supported in the corresponding opening 68 by another bearing 78.

Figure 3:
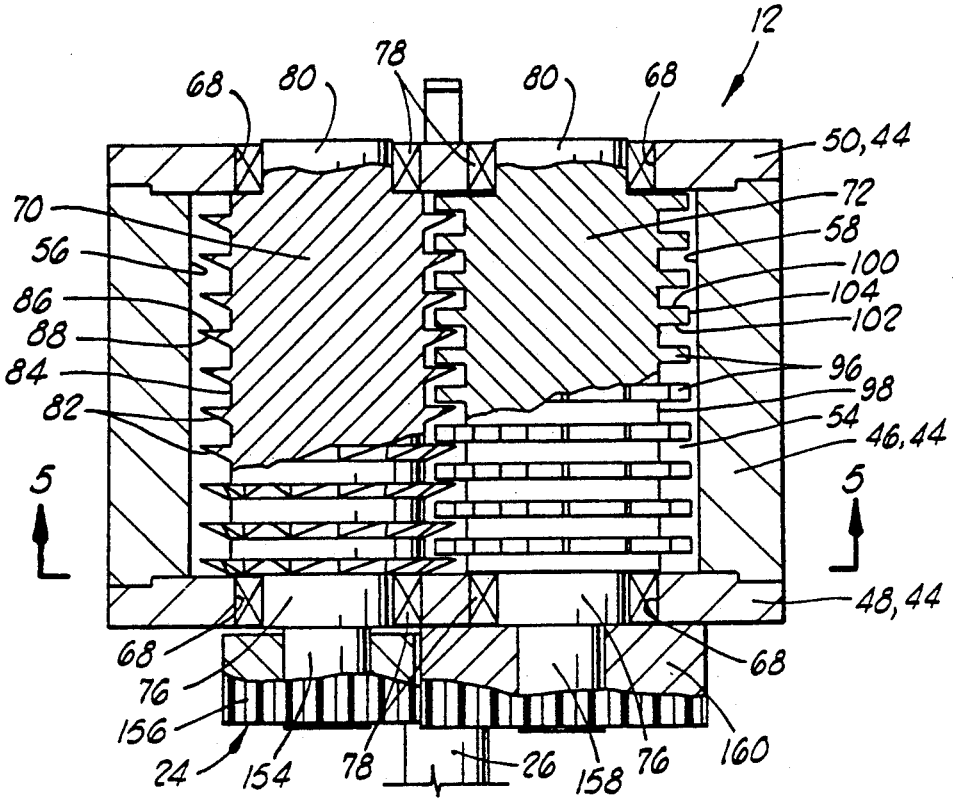
FIG. 3 is a cross section taken along lines 3—3 in FIG. 2.

Referring now primarily to FIGS. 3 and 5, additional details of first rotor 70 are shown. Between first and second shoulder portions 76 and 80 on rotor 70 are a plurality of longitudinally spaced rows of teeth 82 which extend radially outwardly from a cylindrical portion 84. Each row includes a plurality of teeth 82 which are circumferentially or angularly spaced around cylindrical portion 84 of rotor 70.

As shown in cross section in FIG. 3, each tooth 82 preferably has a first side 86 which extends substantially perpendicularly to a tangent of cylindrical portion 84 and an angled second side 88 which extends angularly with respect to first side 86. Referring to FIG. 5 in which teeth 82 are viewed from an end of rotor 70, each tooth 82 is shown to have a first edge 90 and a second edge 92 which extends angularly with respect to first edge 90. Each tooth 82 also may have a substantially flat radially outer edge or tip 94 which extends between first edge 90 and second edge 92. However, if desired, first and second edges 90 and 92 may alternatively intersect to form a pointed tooth with no flat outer edge.

Still referring to FIGS. 3 and 5, the details of second rotor 72 are also shown. Rotor 72 has a plurality of longitudinally spaced rows of teeth 96 which extend radially outwardly from a cylindrical portion 98. Each row on rotor 72 includes a plurality of teeth 96 which are circumferentially or angularly spaced around cylindrical portion 98.

Each tooth 96 has a pair of substantially parallel sides 100 and 102 which are substantially perpendicular to a tangent of cylindrical portion 98. A substantially flat radially outer edge or tip 104 extends between sides 100 and 102 and is substantially perpendicular thereto. Thus, teeth 96 have a substantially rectangular cross section. When viewed from an end of rotor 72, as shown in FIG. 5, it will be seen that each tooth 96 has a first edge 106 and a second edge 108 which extends angularly with respect to first edge 106.

Figure 4:
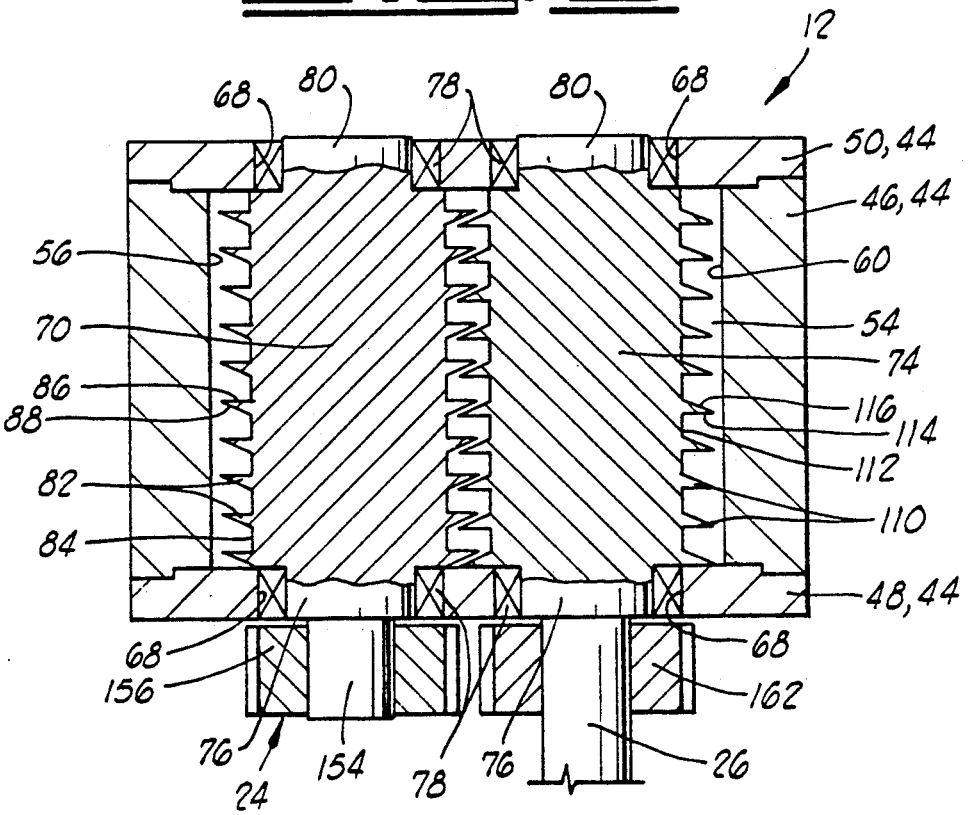
FIG. 4 is a cross section taken along lines 4—4 in FIG. 2.

Referring now to FIGS. 4 and 5, the details of third rotor 74 will be discussed. A plurality of longitudinally spaced rows of teeth 110 extend radially outwardly from a substantially cylindrical portion 112 of third rotor 74. Each row includes a plurality of teeth 110 which are circumferentially or angularly spaced around cylindrical portion 112 of third rotor 74.

Teeth 110 on third rotor 74 are very similar to teeth 82 on first rotor 70. As seen in cross section in FIG. 4, each tooth 110 has a first side 114 which extends substantially perpendicularly to a tangent of cylindrical portion 112 and an angled second side 116 which extends angularly with respect to first side 114. When viewed from the end of rotor 74, as seen in FIG. 5, each tooth 110 has a first edge 118 and a second edge 120 which extends angularly with respect to first edge 118. A substantially flat radially outer edge or tip 122 may interconnect first edge 118 and second edge 120. Alternatively, first and second edges 118 and 120 may intersect at a point with no flat outer edge.

As best seen in FIG. 3, the rows of teeth 82 on first rotor 70 and the rows of teeth 96 on second rotor 72 are staggered with respect to one another along the longitudinal axis of case means 44 and radially overlap such that teeth 82 extend between adjacent teeth 96, and likewise, teeth 96 extend between adjacent teeth 82.

Referring to FIG. 4, it will be seen that the rows of teeth 82 on first rotor 70 are aligned along the longitudinal axis with corresponding rows of teeth 110 on third rotor 74. Angled sides 116 of teeth 110 angle, with respect to cylindrical portion 112 of rotor 74, in an opposite direction from the angle of angled sides 88 of teeth 82 with respect to cylindrical portion 84 of rotor 70. Teeth 82 and teeth 110 radially overlap such that angled sides 88 of a row of teeth 82 are positioned opposite of and generally facing angled sides 116 on the corresponding row of teeth 110. The angled sides of each pair of facing teeth are substantially parallel.

Figure 6:
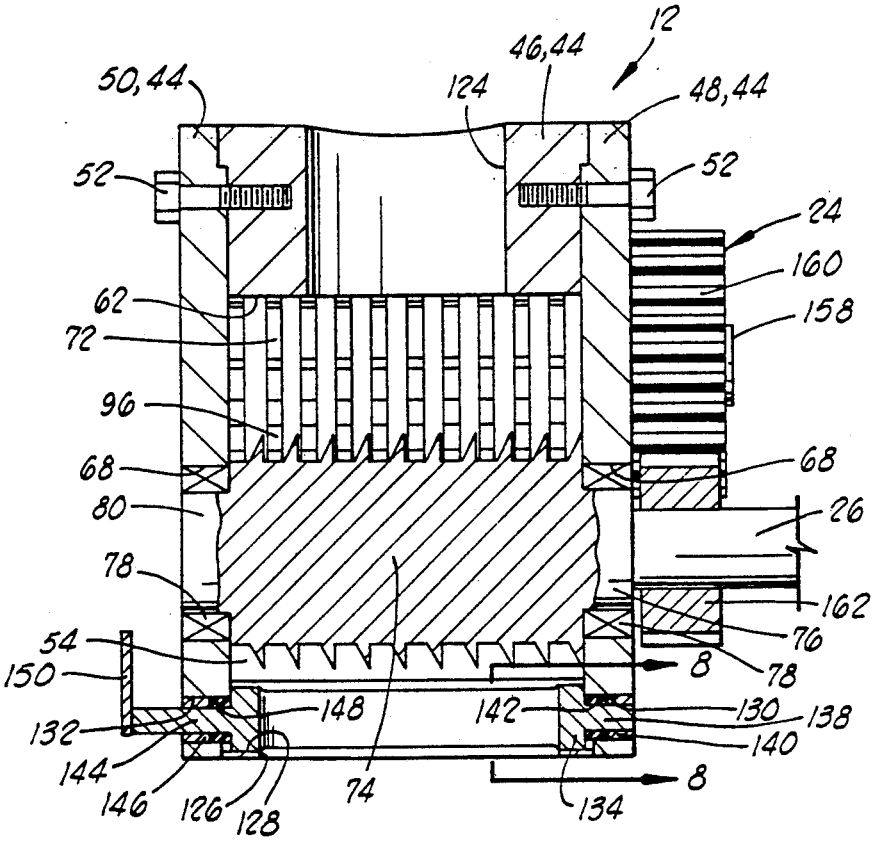
FIG. 6 is a cross section taken along lines 6—6 in FIG. 2.

Referring now to FIG. 6, the rows of teeth 96 on second rotor 72 and the rows of teeth 110 on third rotor 74 are staggered along the longitudinal axis. Referring also to FIG. 5, teeth 96 and teeth 110 radially overlap so that teeth 96 extend between adjacent teeth 110, and teeth 110 correspondingly extend between adjacent teeth 96. In other words, the interaction between teeth 110 on third rotor 74 and teeth 96 on second rotor 72 is substantially the same as the interaction between teeth 82 on first rotor 70 and teeth 96 on second rotor 72.

Now referring to FIGS. 1, 5 and 6, body 46 of case means 44 defines an inlet opening 124 therein which is substantially aligned, and in communication, with inlet 16 of housing 14. Inlet opening 124 is in communication with cavity 54 in body 46 and preferably intersects first and second lobes 56 and 58 of cavity 54. Thus, first and second lobes 56 and 58 may also be referred to as first and second inlet lobes 56 and 58. Similarly, first and second rotors 70 and 72 may be referred to as first and second inlet rotors 70 and 72.

Still referring to FIGS. 1, 5 and 6, and also to FIG. 8, below third lobe 60 of cavity 54, body 46 defines an outlet opening 126 which is preferably in the form of an elongated slot. Thus, third lobe 60 of cavity 54 may be referred to as outlet lobe 60, and third rotor 74 may be referred to as outlet rotor 74.

Also below third lobe 60, body 46 defines a longitudinal bore 128 therethrough. Bore 128 is coaxial with a hole 130 in end plate 48 and another hole 132 in end plate 50. Holes 130 and 132 are shown in FIGS. 2 and 7, respectively, and both in FIG. 6.

Figure 8:
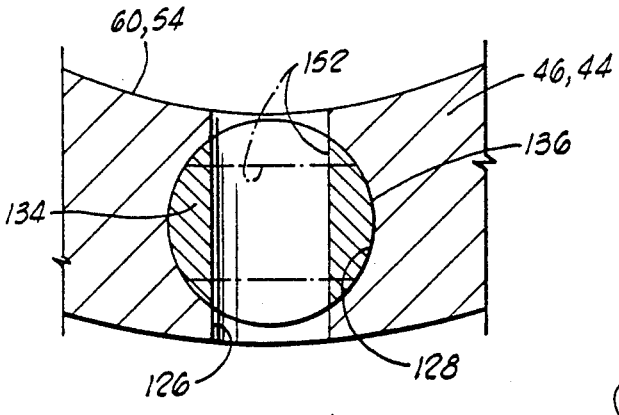
FIG. 8 is a cross section taken along lines 8—8 in FIG. 6.
Figure 9:
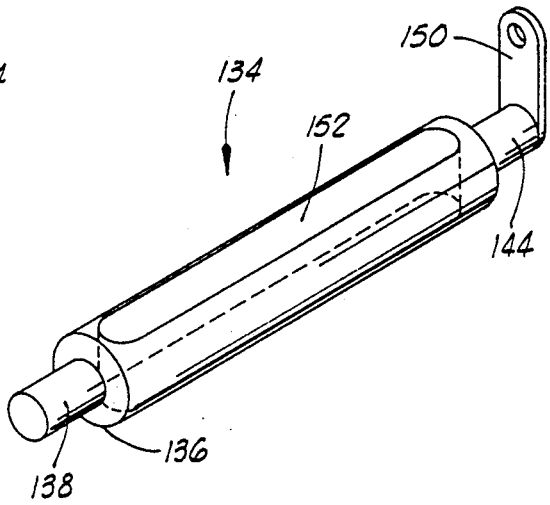
FIG. 9 is a perspective view of the outlet valve used in the grinder section.

As best seen in FIGS. 6 and 8, an outlet valve 134 is disposed adjacent to outlet opening 126 in body 46. Outlet valve 134 has an enlarged diameter, elongated spool portion 136 which rotatably fits in bore 128 in body 126 and is in close, spaced relationship thereto. Outlet valve 134 also has a first shaft portion which extends into hole 132 in end plate 48 and is supported therein by a bearing 140. A sealing means, such as seal 142, is provided for sealing between valve 134 and end plate 48. Seal 142 may be an integral part of bearing 140. On the opposite end of outlet valve 134 is a second shaft portion 144 which extends through hole 132 in end plate 50 and is supported therein by a bearing 146. A sealing means, such as seal 148 provides sealing between outlet valve 134 and end plate 50. Seal 148 may be an integral part of bearing 146. At the outer end of second shaft portion 144 is a handle 150 which may be used to rotate outlet valve 134.

Spool portion 136 of outlet valve 134 defines an opening 152 therethrough in the form of an elongated slot. Opening 152 is essentially the same size as outlet opening 126 in body 46, and when outlet valve 134 is in the open position shown in the drawings, opening 152 is substantially aligned with outlet opening 126. By rotating handle 150 approximately 90° in either direction, outlet valve 134 will be turned to a closed position in which opening 152 is substantially perpendicular to outlet opening 126 as shown by phantom lines in FIG. 8.

Figure 2:
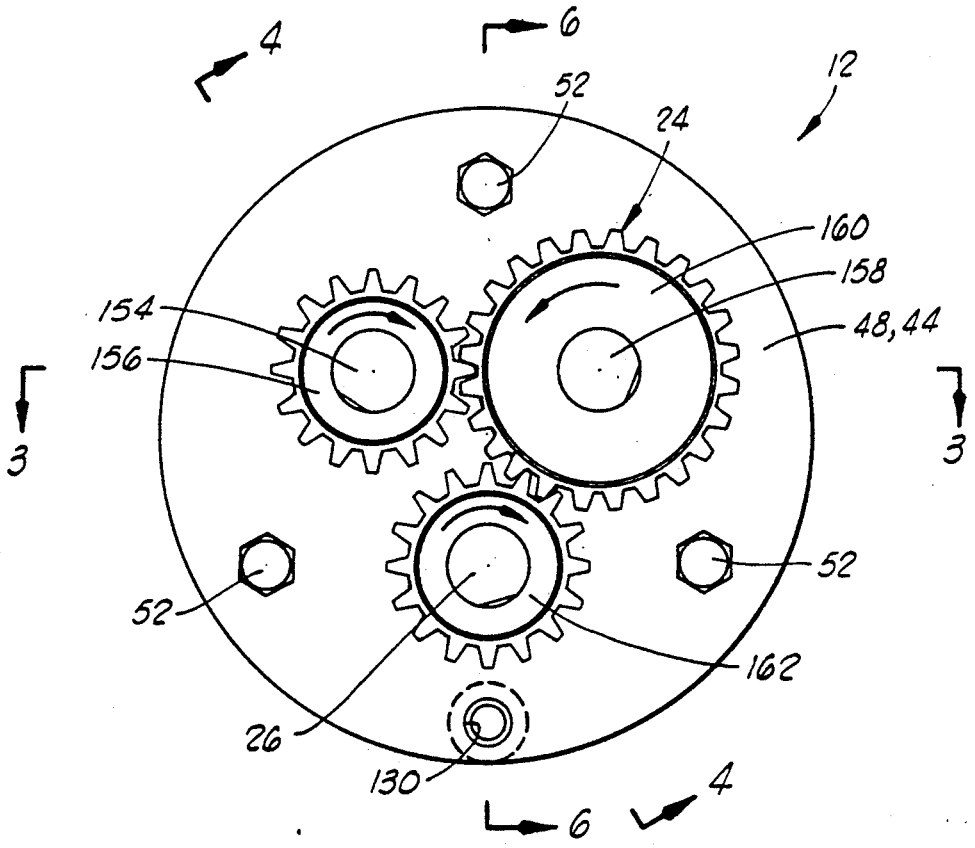
FIG. 2 shows a gear drive end view of a grinder section of the medical waste grinder of FIG. 1.

Referring now to FIGS. 2–4 and 6, and primarily to FIG. 2, the details of gear train 24 will be discussed. Extending from first rotor 70, and preferably forming an integral part thereof, is a shaft 154 on which is mounted a first gear 156, which may also be referred to as small gear 156. Extending from second rotor 72, and preferably forming an integral part thereof, is a shaft 158 on which is mounted a second gear 160, which may be referred to as large gear 160. First gear 156 and second gear 160 are sized and spaced so that they are engaged with one another. In the preferred embodiment, the pitch diameter of second gear 160 is approximately twice the pitch diameter of first gear 156.

Drive shaft 26, which has already been mentioned herein, extends from third rotor 74 and preferably forms an integral part thereof. A third gear 162 is mounted on drive shaft 26 adjacent to end plate 48 and is also engaged with second gear 160. In the preferred embodiment, the pitch diameter of second gear 160 is also approximately twice the pitch diameter of third gear 162. In other words, first and third gears 156 and 162 are preferably approximately the same size. Obviously, first and third gears 156 and 162 are not engaged with one another.

Although third rotor 74 has been shown to be the drive rotor since it has drive shaft 26 extending therefrom, it will be seen by those skilled in the art that the drive shaft could just as easily extend from any of the other rotors. It is not intended that the invention be limited to the particular rotor and gear train configuration shown.

OPERATION OF THE INVENTION

This discussion of the operation of grinder 10 will refer to syringes 164, but it should be understood that the apparatus is adapted for grinding other items of medical waste. For example, but not by way of limitation, grinder 10 may be used to dispose of items such as IV needles or surgical gloves.

To start a grinding process, controls 32 are used to engage motor 28 and also to actuate pump 20, if desired. Motor 28 preferably is adapted to rotate drive shaft 26 in a clockwise direction as seen in FIG. 2. Thus, the engagement of gears 162 and 160 causes shaft 158 to be rotated in a counterclockwise direction, and the engagement of gears 160 and 156 causes shaft 154 to be rotated in a clockwise direction. Referring to FIG. 5, it will be seen that first rotor 70 turns clockwise, and second rotor 72 turns counterclockwise. Thus, both rotors turn toward inlet opening 124. Third rotor 74 turns clockwise in the three rotor embodiment shown.

Used syringes 164 are inserted into inlet nozzle 160 through door 18 as shown in FIG. 1. Disinfectant fluid is pumped through line 22 into inlet nozzle 16 to disinfect the contaminated syringes 164.

Syringes 164 enter grinder section 12 through inlet opening 124 in body 46 and come in contact with first and second rotors 70 and 72 in cavity 54. The opposite rotation of rotors 70 and 72 causes syringes 164 to be pulled between the rotors. The cutting and grinding interaction between teeth 82 on first rotor 70 and teeth 96 on second rotor 72 break up syringes 164 into pieces and begin to grind those pieces. The pieces of syringe 164 will be seen to be fed toward third rotor 74. The interaction of teeth 110 on third rotor 74 with teeth 82 on first rotor 70 and teeth 96 on second rotor 72 further grind and cut the syringe pieces. Because teeth 82 and 110 extend between teeth 96, syringe particles do not build up in the longitudinal spaces between the teeth. Thus, the apparatus is essentially self-cleaning.

Initially, outlet valve 134 is in a closed position so that no portion of syringes 174 may pass through outlet opening 126 in body 46. Thus, the pieces cannot be discharged from cavity 54 and will be carried around third lobe 60 by the rotation of third rotor 74. These syringe pieces will again be cut and ground by the interaction of teeth 110 with teeth 82 and 96. Eventually, the pieces of syringes 164 are cut and ground into a relatively fine powder. Disinfectant pumped into inlet nozzle 16 enters grinder section 12 so that the ground pieces and particles of syringes 164 are thoroughly disinfected. Heat generated by the grinding process further aids in the disinfecting of the syringe particles.

After a predetermined period of time, outlet valve 134 may be opened so that the finely ground particles will fall through outlet opening 126 into collection jar 36. When collection jar 36 is filled, controls 32 are used to shut off motor 28 and pump 20, after which door 42 may be opened so that collection jar 36 may be removed and cleaned.

It will be seen, therefore, that the medical waste grinder of the present invention is well adapted to carry out the ends and advantages mentioned as well as those inherent therein. While a presently preferred embodiment of the invention has been described for the purposes of this disclosure, numerous changes in the arrangement and construction of parts may be made by those skilled in the art. All such changes are encompassed within the scope and spirit of the appended claims.

What is claimed is:

1. An apparatus for grinding medical waste into fine particles, said apparatus comprising:

case means for forming an enclosure having a plurality of interconnecting cylindrical bores, an inlet and an outlet, said plurality of interconnecting cylindrical bores including first and second interconnecting cylindrical bores positioned side by side adjacent to said inlet, and said interconnecting bores comprising a third interconnecting cylindrical bore adjacent said outlet;

a plurality of cylindrical rotors rotatably disposed in said enclosure, each of said rotors disposed in one of said cylindrical bores and having a plurality of longitudinally spaced rows of teeth thereon, said plurality of cylindrical rotors including first and second cylindrical rotors disposed adjacent to one another in said first and second cylindrical bores, respectively said cylindrical rotors comprising a third cylindrical rotor disposed in the third cylindrical bore, the teeth on one of said second and third rotors and the teeth on said first rotor being substantially aligned along a longitudinal axis, said teeth on said one of said second and third rotors and said teeth on said first rotor each comprising a first side extending substantially radially from said corresponding rotor and a second angled side extending angularly with respect to the first side, said angled sides of said teeth on said one of said second and third rotors being angled in an opposite direction from and overlapping with said angled sides of said teeth on said first rotor such that said angled sides of said teeth on said one of said second and third rotors are substantially parallel to and generally face said angled sides of said teeth on said first rotor, whereby medical waste inserted into said enclosure through said inlet is forced between said first and second rotors and ground by said teeth thereon; and means for rotating said first and second rotors in opposite directions.

2. The apparatus of claim 1 further comprising means for rotating said first and second rotors at different speeds.

3. The apparatus of claim 1 further comprising means for rotating one of said first and second rotors and said third rotor in the same direction.

4. The apparatus of claim 1 wherein the teeth on the other of said one of said second and third rotors have a substantially rectangular cross section.

5. The apparatus of claim 1 wherein each of said rows of teeth comprises a plurality of teeth angularly spaced around the corresponding rotor.

6. The apparatus of claim 1 further comprising means for receiving ground medical waste particles discharged through said outlet.

7. The apparatus of claim 1 further comprising means for injecting a disinfectant into said inlet.

8. The apparatus of claim 1 further comprising a gear train interconnecting said rotors.

9. The apparatus of claim 8 further comprising a drive shaft extending from one of said rotors.

10. The apparatus of claim 9 wherein said drive shaft extends from said third rotor.

11. The apparatus of claim 1 further comprising a discharge valve disposed across said outlet.

12. The apparatus of claim 11 wherein:

said outlet is characterized by a slot defined in said enclosure; and said discharge valve comprises an elongated spool defining a slot therein alignable with said slot in said enclosure.

13. The apparatus of claim 1 wherein said case means comprises:

a body; and a pair of end plates disposed on opposite sides of said body.

14. The apparatus of claim 13 wherein opposite portions of said rotors are supported in said end plates.

15. The apparatus of claim 1 further comprising a housing; and wherein said case means are positioned in said housing.

16. The apparatus of claim 15 wherein said housing comprises a nozzle adjacent to said inlet.

17. The apparatus of claim 16 wherein said nozzle extends at an acute angle with respect to a longitudinal axis of said enclosure.

18. The apparatus of claim 16 further comprising a spring biased door on said nozzle.

19. An apparatus for grinding medical waste into fine particles, said apparatus comprising:

a first cylindrical rotor having a plurality of longitudinally spaced teeth thereon, each of said teeth having an angled side extending at an angle which is substantially the same as the others of said teeth on said first rotor; and a second cylindrical rotor having a plurality of longitudinally spaced teeth thereon substantially aligned with said teeth on said first rotor, each of said teeth on said second rotor having an angled side extending at an angle which is substantially the same as the others of said teeth on said second rotor, said angled sides of said teeth on said second rotor being angled in an opposite direction from and overlapping with said angled sides of said teeth on said first rotor such that said angled sides of said teeth on said second rotor are substantially parallel to and generally face the corresponding angled sides of said teeth on said first rotor.

20. The apparatus of claim 10 further comprising a third cylindrical rotor having a plurality of longitudinally spaced teeth thereon which extend between said teeth on said first rotor and said teeth on said second rotor.

21. The apparatus of claim 20 wherein said teeth on said third rotor have substantially parallel sides.

22. The apparatus of claim 20 further comprising:

a body defining a cavity therein, said rotors being disposed in said cavity; and a pair of end plates on opposite sides of said body, opposite portions of said rotors being disposed through openings defined in said end plates.

23. The apparatus of claim 22 further comprising bearings for supporting said portions of said rotors in said openings in said end plates.

24. The apparatus of claim 19 wherein said teeth on said rotors further comprise:

a first edge extending outwardly from said rotors; and a second edge extending at an angle with respect to said first edge.

25. The apparatus of claim 24 wherein said teeth further comprise a radially outer tip interconnecting said edges.

26. The apparatus of claim 19 wherein said teeth on said first and second cylindrical rotors each further have a substantially straight side extending substantially radially from said corresponding rotor, and said angled sides of said teeth on said first and second rotors extend angularly with respect to said corresponding substantially straight sides.

* * * * *